United States Patent [19]

Ekholm et al.

[11] Patent Number: 4,961,844

[45] Date of Patent: Oct. 9, 1990

[54] APPARATUS FOR SEPARATING A SUSPENSION OF FIBROUS CELLULOSE PULP

[75] Inventors: Rolf Ekholm; Rune Hillström; Daniel Palsson, all of Karlstad, Sweden

[73] Assignee: Kamyr AB, Karlstad, Sweden

[21] Appl. No.: 332,020

[22] Filed: Mar. 28, 1989

[30] Foreign Application Priority Data

May 5, 1988 [SE] Sweden ..... 8801703

[51] Int. Cl.[5] ..... B07B 1/20

[52] U.S. Cl. ..... 209/273; 209/300

[58] Field of Search ..... 209/273, 397, 270, 305, 209/306, 380, 300; 210/498; 241/24, 46.11, 46.17, 46.06, 69, 74

[56] References Cited

U.S. PATENT DOCUMENTS

| | | | |
|---|---|---|---|
| 3,363,759 | 1/1968 | Clarke-Pounder | 209/273 |
| 3,458,038 | 7/1969 | Young | 209/273 |
| 3,586,172 | 6/1971 | Young | 209/273 |
| 3,726,401 | 4/1973 | Bolton, III et al. | 209/306 X |
| 4,202,759 | 5/1980 | Krolopp et al. | 209/273 |
| 4,680,108 | 7/1987 | Ahs | 209/273 |
| 4,699,324 | 10/1987 | Ahs | 241/24 |

FOREIGN PATENT DOCUMENTS

| | | | |
|---|---|---|---|
| 658529 | 6/1929 | France | 209/306 |

*Primary Examiner*—Donald T. Hajec

*Attorney, Agent, or Firm*—Nixon & Vanderhye

[57] ABSTRACT

A suspension of fibrous cellulose pulp is separated into at least two portions in an apparatus comprising a closed housing having inlet and outlets, and a rotor means provided with projections, said rotor means comprising a first rotor part surrounded by a screening means, the first rotor part and the screening means in their axial extension forming a screening zone and being arranged to cooperate with each other during rotation of the first rotor part for screening the suspension in a fluidized state. The rotor means comprises a second rotor part located immediately adjacent to the first rotor part, a rigid, water-impervious wall member surrounding the second rotor part. The second rotor part and the wall member form in their axial extension a pre-treating zone located immediately upstream of the screening zone and cooperate with each other during rotation of the second rotor part, Futhermore, the second rotor part has projections which, during rotation of the rotor part, run along the inner cylindrical surface of the wall member, without coming into contact therewith, so that the suspension is pre-treated and converted into a fluidized state suitable for screening in the screening zone located immediately thereafter.

29 Claims, 2 Drawing Sheets

APPARATUS FOR SEPARATING A SUSPENSION OF FIBROUS CELLULOSE PULP

FIELD AND BACKGROUND OF THE INVENTION

The present invention relates to an apparatus for separating a suspension of fibrous cellulose pulp into at least two portions in a closed housing having inlet and outlets, said apparatus having a rotor means provided with projections, said rotor means comprising a first rotor part surrounded by a screening means, the first rotor part and the screening means in their axial extension forming a screening zone and being arranged to cooperate with each other during rotation of the first rotor part for screening the suspension in fluidized state.

In order to subject a fibrous cellulose pulp of medium concentration, i.e. about 6–15%, to a screening operation, a screening device has to be used which generates pulsations and shearing forces in the pulp so that it becomes fluidized, i.e. is converted into a light flowing form, thus enabling the fibers to move in relation to each other. A part-flow of finer fibrous material (accept) and a part-flow of courser material (reject) can then be obtained by means of screening. A screening apparatus based on the above principle is described in U.S. Pat. No 4,680,108.

A problem encountered in this known apparatus is that the inject can be thickened in the first section of the screening zone, probably because of the fact that the suspension has not yet been fluidizid in this part, at the same time as increasing quantities of fiber bundles collect. Due to this thickening the screening means in the form of a screening basket will be subjected to pressure forces and increased torque from the rotor during its rotation which, besides an increased power requirement, can result in deformation of the screening basket. The capacity and efficiency of the apparatus are also reduced.

SUMMARY OF THE INVENTION

The object of the present invention is to eliminate the above-mentioned problem and provide an apparatus enabling the suspension to be supplied to the screening zone in a state just suited for immediate screening so that the suspension is not thickened due to a high degree of dewatering in the first section of the screening zone. The power requirement is also considerably reduced, while capacity and efficiency can be maintained as desired, and even improved.

This object is achieved according to the invention in that the apparatus for separating a suspension of fibrous cellulose pulp into at least two portions comprises a closed housing having inlet and outlets, and a rotor means provided with projections and comprising a first rotor part surrounded by a screening means, the first rotor part and the screening means in their axial extension forming a screening zone and being arranged to cooperate with each other during rotation of the first rotor part for screening the suspension in a fluidized state, said rotor means further comprising a second rotor part located immediately adjacent to the first rotor part, a rigid, water-impervious wall member surrounding said second rotor part, the second rotor part and the wall member in their axial extension forming a pre-treating zone located immediately upstream of the screening zone and cooperating with each other during rotation of the second rotor part, and said second rotor part having projections which, during rotation of the rotor part, run along the inner cylindrical surface of the wall member, without coming into contact therewith, so that the suspension is pre-treated and converted into a fluidized state suitable for screening in said screening zone located immediately thereafter.

BRIEF DESCRIPTION OF THE DRAWINGS

The invention will be described further in the following with reference to the accompanying drawings.

DETAILED DESCRIPTION OF THE DRAWINGS

Figure 1:
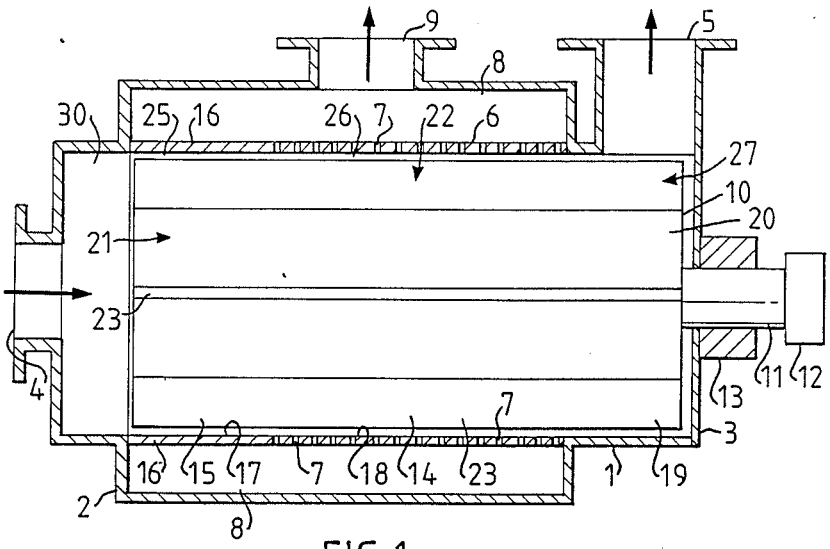
FIG. 1 shows schematically an apparatus according to a preferred embodiment in a longitudinal section.

FIG. 1 shows schematically parts of a screening apparatus comprising a housing having a cylindrical body 1 and two end walls 2, 3, one of which being provided with an axial inlet 4 for the suspension (inject) to be screened. Close to the other end wall 3 is an outlet 5 for the material remaining after screening (reject). The end walls 2, 3 are assembled on the body 1 by means of suitable flanges (not shown).

A screening means 6 is disposed in the housing. In the embodiment shown it consists of a cylindrical screening plate having suitable openings 7 in the form of holes or slots to screen off a finer fraction, i.e. the accept, from the pulp. The screening plate 6 is surrounded by an annular accept chamber 8 for receiving the screened accept, the body 1 being provided with an accept outlet 9 communicating with the accept chamber 8 to conduct the accept further in the process line.

The apparatus comprises a rotor means 10, supported by a horizontal rotatable shaft 11 extending through the end wall 3 opposite to the inlet 4. The shaft 11 is driven by a motor 12 and it is journalled in a bearing unit 13 with suitable sealing means at the end wall 3 to ensure necessary sealing between housing and shaft 11.

The rotor means 10 comprises a first rotor part 14, surrounded by the screening plate 6 and extending concentrically in relation thereto. According to the present invention the rotor means 10 also includes a second rotor part 15 which extends from the first rotor part 14 in the direction to an inject chamber 30 at the inlet 4. The apparatus according to the invention thus comprises a stationary, rigid, water-impervious wall member 16 which surrounds the second rotor part 15, said part extending concentrically in relation thereto. The tight wall member 16 has a cylindrical inner surface 17 which, in the embodiment shown in FIG. 1, has the same diameter as the inner surface 18 of the screening plate 6.

In the embodiment shown the wall member 16 is designed as a plate cylinder firmly connected to the cylindrical screening plate 6 and forming an integral construction unit therewith. The screening plate 6 and plate cylinder 16 may thus be manufactured from one and the same piece of sheet.

The wall member 16 is rigidly mounted in the housing close to the end wall 2 and is internally in direct communication with the inject chamber 30 at the inlet 4.

The rotor means also includes a third rotor part 19, which extends through the region for the reject outlet 5 to the vicinity of the end wall 3.

In the shown preferred embodiment the rotor means is designed as a single elongate rotor, said three rotor parts 14, 15, 19 passing into each other without visible distinction. The elongate rotor 10 comprises a central, axial body 20 having a smaller diameter or cross-sectional dimension than the diameters of the wall member 16 and screening means 6. Annular spaces 21 and 22 are thus formed between the central body 20 and the wall member 16 and between the central body 20 and the screening member 6, respectively, for the suspension supplied to the apparatus. The rotor 10 is provided with a plurality of projections 23, rigidly mounted to or integrally formed with the central body 20. The projections extend along and radially outwards from the central body 20 to pass along the inner cylindrical surfaces 17, 18 of the wall member 16 and screening means 6, without contacting said surfaces and thus at a suitably small distance therefrom. The projections 23 may consist of ribs, blades or, as shown in FIG. 1, vanes. Four vanes extending substantially axially are used in the embodiment according to FIG. 1. The number of vanes or other projections 23 may vary depending on the capacity of the apparatus, the screening properties of the suspension, etc. Alternatively the vanes may be suitably inclined to extend spirally along the central body. They are in this case suitably directed to give a favorable feeding effect on the suspension. To achieve increased discharge effect, the third rotor part 19 may be provided with vanes or the like having larger radial extension than is shown in FIG. 1, in which case the body 1 should be enlarged radially to a corresponding extent close to the end wall 3 to afford space for such wider vanes.

According to the present invention the inner surface 17 of the wall member 16 is provided with a plurality of recesses of predetermined dimensions and distributed circumferentially in predetermined manner. The recesses are in the form of relatively short, narrow grooves 24, which in accordance with experiments performed may have a length of 30–40 mm, a width of 3–5 mm and a depth of 0.5–1 mm. They may be disposed in a plurality of circles, axially directed with a distance of 20–50 mm between two parallel grooves 24 and a distance of 10–30 mm between two rows of grooves 24. In the embodiment of the wall member shown in FIGS. 2 and 3 the grooves 24 have limited longitudinal extension.

A pre-treating zone 25 is formed within the axial extension of the wall member 18, the second rotor part 15 and the space 21 defined therebetween, which communicates directly with the inject chamber 30 and the space 22 located downstream. A screening zone 26 is formed in the same way within the axial extension of the screening means 6, the first rotor part 14 and the space 22 defined therebetween, which communicates directly with the space 21 of the pre-treating zone 25 and with the outlet 5 via a corresponding annular space 27 around the third rotor part 19. In said pre-treating zone 25 the suspension supplied will be converted and adjusted into an optimal or substantially optimal state allowing it to be screened without any serious thickening of the suspension and resulting clogging of the screening openings 7 being arisen when the suspension reaches the screening zone 26. The rotation speed of the rotor 10 is chosen sufficiently high so that the suspension supplied for screening is fluidized by the fast movements of the rotor vanes 23 through the suspension creating turbulences, pulsations and shearing forces in the suspension as the vanes pass with high peripheral speed along the inner surface 17 of the wall member 16 and the inner surface 18 of the screening means 6. This effect of turbulences, pulsations and shearing forces is further strengthened in the pre-treating zone 25 by the irregularities on the inner surface 17 of the wall member 16. In the embodiment shown in FIGS. 2 and 3 the irregularities are formed by a large number of short grooves 24. The violent treatment also results in a favorable reduction in the shive content since the fiber bundles included are efficiently disintegrated, thereby contributing to the formation of a uniform fluidized suspension. The fluidization means that the suspension is converted into a uniform easy flowing form in which the fibers are not bounded to each other by adhesion forces, but are able to move freely in relation to each other. Since the suspension is made prepared for screening in the pre-treating zone 25, i.e. the fiber bundles are disintegrated and the suspension converted into the fluidized state in which it then reaches the screening zone 26, and which is also maintained in the screening zone, dewatering of the suspension is reduced to a minimum, because of the fact that the fibers behave like a liquid and therefore are able to pass through the screening openings 7 together with the liquid. The suspension does not thicken at the start of the screening zone 26 and the risk of the screening means 6 being subjected to detrimental pressure and torsional forces from the rotor vanes 23, resulting in deformation of the screening means, has in this way been eliminated. The improved operating conditions also result in a considerable reduction of the power requirement.

Figure 4:
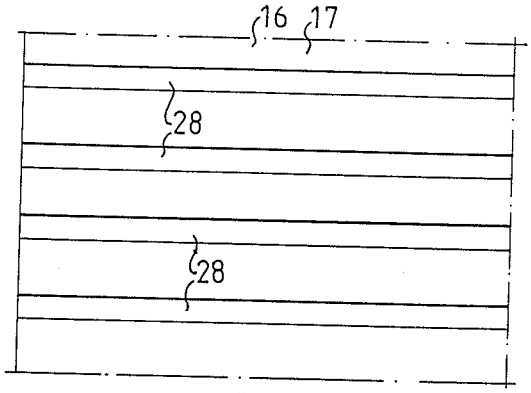
FIGS. 4 and 5 show parts of a wall member from the inside and in cross section, respectively, according to a second embodiment.
Figure 5:
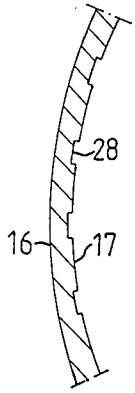

According to another embodiment of the wall member, the recesses are performed as continuous grooves 28, as illustrated in FIGS. 4 and 5. The grooves 28 extend between the ends of the wall member 16 and are open at the end facing the inject chamber 30. Axial feedback of the suspension is thus achieved through the grooves 28 into the inject chamber 30. This feedback further improves the effect of preventing clogging of the screening openings 7 in the screening means 6. The grooves 28 may even be open at the end facing the screening means 6. In this case the wall member 16 is performed with a smaller inner diameter than that of the screening means 6. The difference in diameters and the depth of the grooves 28 can then be matched with respect to each other so that the bottom surfaces of the grooves 28 are positioned in the line or plane with the inner surface 18 of the screening means 6. The radial extension of the vanes 23 or other projections on the second rotor part 15 should then be correspondingly decreased.

Figure 2:
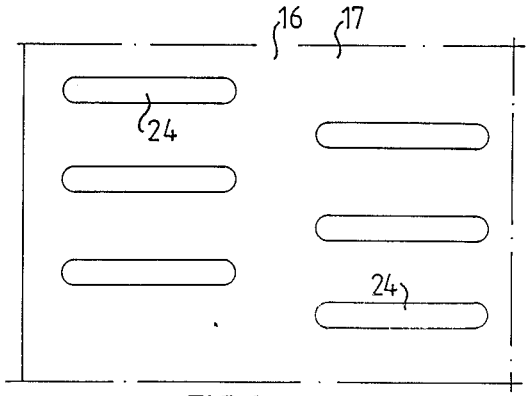
FIGS. 2 and 3 show parts of a wall member in the apparatus according to FIG. 1 from the inside and in cross section, respectively.
Figure 3:
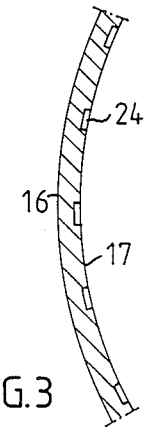

In the embodiment shown in FIGS. 2 and 3 and also in that shown in FIGS. 4 and 5, the recesses 24, 28 may be arranged at a slight angle with respect to the axial direction shown. An area between two recesses may in fact be considered as a radial projection although it lies in the same plane as the inner surface 17 of the wall member. Alternatively, or in addition to recesses special radial projections may be used, e.g. between two neighbouring recesses.

Figure 6:
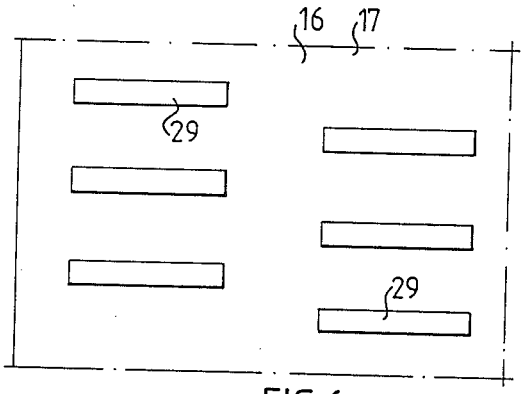
FIGS. 6 and 7 show parts of a wall member from the inside and in cross section, respectively, according to a third embodiment.
Figure 7:
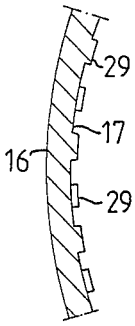

FIGS. 6 and 7 show a third alternative embodiment of a wall member 18, the inner surface 17 of which being provided with a plurality of radial projections in the form of relatively short, narrow ridges or ribs 29 which may have the same dimensions as the grooves 24 in FIGS. 2 and 3. Alternatively the ribs 29 may extend continuous between the ends of the wall member in the same way as the continuous grooves 28 shown in FIGS. 4 and 5.

Figure 8:
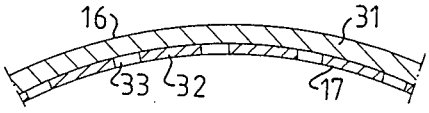
FIG. 8 shows part of a wall member in cross section according to a fourth embodiment.

FIG. 8 shows yet another embodiment of the wall member 16, comprising a rigid, outer, cylindrical support element 31 and a sleeve 32 disposed therein, the inner surface of the sleeve forming the inner surface 17 of the wall member and possibly being provided with recesses and/or projections as described above. The shown sleeve 32 is provided with through-openings 33 which, when the sleeve 32 is placed inside the support element 31 and in close contact therewith, are closed thereby and thus form corresponding recesses in the wall member 16. According to the invention, said recesses are not passing through the wall member. When the wall member becomes worn, only the sleeve 32 need be replaced instead of the whole wall member (and the screening means if these are formed as an integral part). In the case the support element and screening means constitute an integral part, e.g. are manufactured from one and the same piece of sheet-metal, the inner diameter of the wall member 16 formed by the sleeve 32 will be slightly less than the inner diameter of the screening means 6 corresponding to twice the wall thickness of the sleeve 32. Alternatively, the inner diameters of the sleeve 32 and the screening means 6 may be the same, in which case the support element 31, of the wall member 16 against which the sleeve 32 shall be in close surface contact, is enlarged or correspondingly adapted.

In the apparatus shown in FIG. 1 the pulp is separated into two portions. However, it may also be separated into several portions if desired. In such an embodiment the screening means may consist of two consecutively arranged screening plates with different sized screening openings in order to obtain two different accepts, each of which being collected in an accept chamber surrounding the relevant screening plate.

In the embodiment shown in FIG. 1 the rotor means is journalled at one end of the housing. The rotor means may alternatively be journalled at both ends of the housing, e.g. with a through-shaft. The inlet for the inject may in this case be disposed at the side of the housing, e.g. radially directed.

According to an alternative embodiment of the invention, the two rotor parts are separated, i.e. the rotor means consists of a first rotor disposed in a screening zone and a second rotor disposed in a pre-treating zone, the rotors being journalled one at each end of the housing and each driven by its own motor. In this way it is possible to drive the rotors at different speeds if desired.

The rotation speed of the rotor means is chosen such that its vanes achieve a peripheral speed sufficient to produce said fluidized state. Such a peripheral speed is normally about 20–25 m/sec for pulp of medium concentration.

That which is claimed is:

1. An apparatus for separating a suspension of fibrous cellulose pulp into at least two portions comprising a closed housing having inlet and outlets, and a rotor means in the form of an integral elongate rotor having first and second parts driven by a common shaft, and having vanes extending over both said parts, said first rotor part surrounded by a screening means, the first rotor part and the screening means in their axial extension forming a screening zone and being arranged to cooperate with each other during rotation of the first rotor part for screening the suspension in a fluidized state, said second rotor part located immediately adjacent to the first rotor part; a rigid, water-impervious wall member surrounding said second rotor part, said wall member having a plurality of recesses on an inner surface thereof, the second rotor part and the wall member in their axial extension forming a pre-treating zone located immediately upstream of the screening zone and cooperating with each other during rotation of the second rotor part, wherein the length of the pre-treating zone constitutes about 20–100% of the length of the screening zone, and said vanes of said second rotor part, during rotation of the rotor part, run along the inner surface of the wall member, without coming into contact therewith; means for effecting rotation of said rotor at a speed sufficient to fluidize the pulp in said pre-treating zone for subsequent screening in said screening zone located immediately thereafter, and wherein the screening means and the wall member are in the form of a cylinder unit manufactured from one and the same piece of sheet metal.

2. An apparatus as claimed in claim 1 wherein said recesses are in the form of short axial or inclined grooves, disposed in rows around the inner surface of the wall member.

3. An apparatus as claimed in claim 2 wherein each groove has a length of about 20–30 mm, a width of about 3–5 mm and a depth of about 0.5–1 mm, and wherein the distance between two grooves in a row is about 20–50 mm and the distance between two rows of grooves is about 10–30 mm.

4. An apparatus as claimed in claim 1 wherein the recesses are in the form of continuous axial or inclined grooves extending between the ends of the wall member.

5. An apparatus as claimed in claim 1 wherein the length of the pre-treating zone constitutes about 20–100% of the length of the screening zone.

6. An apparatus as claimed in claim 5 wherein the pre-treating zone constitutes about 30–50% of the length of the screening zone.

7. An apparatus as claimed in claim 1 wherein the wall member comprises an outer, cylindrical support element and a sleeve disposed therein, said sleeve being in contact with the support element and forming the inner surface of the wall member.

8. An apparatus as claimed in claim 7 wherein the sleeve is replaceably mounted in the support element.

9. An apparatus as claimed in claim 7 wherein the sleeve has through-openings arranged to be closed by the support element when the sleeve is placed therein, thus forming said recesses in the wall member.

10. An apparatus as claimed in claim 7 wherein the screening means and the support element of the wall member are rigidly connected to each other or formed as a cylinder unit.

11. An apparatus as claimed in claim 10 wherein the support element and the screening means are manufactured from one and the same piece of sheet metal and thus have the same internal diameter.

12. An apparatus as claimed in claim 1 wherein the cellulose pulp supplied lies within the range of medium concentration.

13. An apparatus for separating a suspension of fibrous cellulose pulp into at least two portions comprising a closed housing having inlet and outlets, and a rotor means in the form of an integral elongate rotor having first and second parts driven by a common shaft, and having vanes extending over both said parts, said first rotor part surrounded by a screening means, the first rotor part and the screening means in their axial extension forming a screening zone and being arranged to cooperate with each other during rotation of the first rotor part for screening the suspension in a fluidized state, said second rotor part located immediately adjacent to the first rotor part; a rigid, water-impervious wall member surrounding said second rotor part, said wall member having a plurality of projections on an inner surface thereof, the second rotor part and the wall member in their axial extension forming a pre-treating zone located immediately upstream of the screening zone and cooperating with each other during rotation of the second rotor part, wherein the length of the pre-treating zone constitutes about 20–100% of the length of the screening zone, and said vanes of said second rotor part, during rotation of the rotor part, run along the inner surface of the wall member, without coming into contact therewith; means for effecting rotation of said rotor at a speed sufficient to fluidize the pulp in said pre-treating zone for subsequent screening in said screening zone located immediately thereafter; and wherein the screening means and the wall member are in the form of a cylinder unit manufactured from one and the same piece of sheet metal.

14. An apparatus as claimed in claim 13 wherein the projections are in the form of axial or inclined ribs or the like, disposed in rows around the inner surface of the wall member.

15. An apparatus as claimed in claim 13 wherein the wall member comprises an outer, cylindrical support element and a sleeve disposed therein, said sleeve being in contact with the support element and forming the inner surface of the wall member.

16. An apparatus as claimed in claim 15 wherein the sleeve is replaceably mounted in the support element.

17. An apparatus as claimed in claim 15 wherein the sleeve has through-openings arranged to be closed by the support element when the sleeve is placed therein, thus forming said recesses in the wall member.

18. An apparatus as claimed in claim 15 wherein the screening means and the support element of the wall member are rigidly connected to each other or formed as a cylinder unit.

19. An apparatus as claimed in claim 18 wherein the support element and the screening means are manufactured from one and the same piece of sheet metal and thus have the same internal diameter.

20. An apparatus as claimed in claim 13 wherein the cellulose pulp supplied lies within the range of medium concentration.

21. An apparatus as claimed in claim 13 wherein the length of the pre-treating zone constitutes about 20–100% of the length of the screening zone.

22. An apparatus as claimed in claim 21 wherein the length of the pre-testing zone constitutes about 30–50% of the length of the screening zone.

23. An apparatus for separating a suspension of fibrous cellulose pulp into at least two portions comprises a closed housing having inlet and outlets, and a rotor means provided with projections and comprising a first rotor part surrounded by a screening means, the first rotor part and the screening means in their axial extension forming a screening zone and being arranged to cooperate with each other during rotation of the first rotor part for screening the suspension in a fluidized state, said rotor means further comprising a second rotor part located immediately adjacent to the first rotor part, a rigid, water-impervious wall member surrounding said second rotor part, the second rotor part and the wall member in their axial extension forming a pre-treating zone located immediately upstream of the screening zone and cooperating with each other during rotation of the second rotor part, and said second rotor part having projections which, during rotation of the rotor part, run along the inner cylindrical surface of the wall member, without coming into contact therewith, so that the suspension is pre-treated and converted into a fluidized state suitable for screening in said screening zone located immediately thereafter, wherein the wall member comprises an outer, cylindrical support element and a sleeve disposed therein, said sleeve being in contact with the support element and forming the inner surface of the wall member.

24. An apparatus as claimed in claim 23 wherein the sleeve is replaceably mounted in the support element.

25. An apparatus as claimed in claim 23 wherein the sleeve has through-openings arranged to be closed by the support element when the sleeve is placed therein, thus forming said recesses in the wall member.

26. An apparatus as claimed in claim 25 wherein the screening means and the support element of the wall member are rigidly connected to each other or formed as a cylinder unit.

27. An apparatus as claimed in claim 26 wherein the support element and the screening means are manufactured from one and the same piece of sheet metal and thus have the same internal diameter.

28. An apparatus as claimed in claim 23 wherein the cellulose pulp supplied lies within the range of medium concentration.

29. A method of separating a suspension of fibrous cellulosic pulp having a consistency of about 6–15% into accepts and rejects, utilizing a closed housing having an inlet and an outlet, a rotor rotatable in the housing, a screening plate mounted concentrically within said housing and surrounding at least a part of said rotor, and a solid wall portion having surface irregularities on an interior surface thereof and located upstream and contiguous with the screening plate; the method comprising the steps of:

(a) introducing the pulp into the inlet of the housing;
(b) rotating the rotor at a peripheral speed of between about 20–25 meters per second to effect fluidization of the pulp at the solid wall portion upstream of the screening plate, said surface irregularities serving to enhance the fluidization of the pulp;
(c) continuing to act on the pulp with the rotor as the pulp moves from the inlet to the outlet so as to force the accepts through the screen wall of the housing; and
(d) discharging the rejects through the outlet of the housing.

* * * * *